US005679273A

United States Patent [19]

Petetin

[11] Patent Number: 5,679,273

[45] Date of Patent: Oct. 21, 1997

[54] COOKTOP HAVING A FLAT SURFACE, SUITABLE FOR FLUSH-MOUNTING

[75] Inventor: Sylvie Petetin, Bougival, France

[73] Assignee: Sollac (Societe Anonyme), Puteaux, France

[21] Appl. No.: 509,725

[22] Filed: Aug. 1, 1995

[30] Foreign Application Priority Data

Aug. 4, 1994 [FR] France ..... 94 09700

[51] Int. Cl.[6] ..... H05B 3/68

[52] U.S. Cl. ..... 219/468; 219/458; 219/467

[58] Field of Search ..... 219/443, 463, 219/464, 465, 466, 467, 468, 457, 458

[56] References Cited

U.S. PATENT DOCUMENTS

| | | | |
|---|---|---|---|
| 335,261 | 8/1886 | Seigla et al. | 219/464 |
| 3,406,278 | 10/1968 | Bassett, Jr. et al. | 219/464 |
| 3,733,462 | 5/1973 | Bouchard et al. | 219/464 |
| 3,805,023 | 4/1974 | Wainer et al. | 219/464 |
| 3,866,018 | 2/1975 | Hurko | 219/464 |
| 4,009,795 | 3/1977 | Hurko et al. | 219/464 |
| 4,237,368 | 12/1980 | Welch | 219/464 |
| 4,363,956 | 12/1982 | Scheidler et al. | 219/467 |
| 4,608,962 | 9/1986 | Ng | 219/467 |
| 4,843,218 | 6/1989 | Husslein et al. | 219/468 |
| 4,960,978 | 10/1990 | Lorenz et al. | 219/467 |
| 5,185,047 | 2/1993 | Ray | 219/466 |
| 5,374,807 | 12/1994 | Yahav et al. | 219/465 |

FOREIGN PATENT DOCUMENTS

| | | |
|---|---|---|
| 0229928 | 11/1986 | European Pat. Off. . |
| 2127555 | 6/1971 | Germany . |

OTHER PUBLICATIONS

International Search Report.

*Primary Examiner*—Teresa J. Walberg
*Assistant Examiner*—Sam Paik
*Attorney, Agent, or Firm*—Sixbey Friedman Leedom & Ferguson; Thomas W. Cole

[57] ABSTRACT

The invention relates to a flush-mountable cooktop having a steel support table covered on its two faces by a layer of an electrically insulating material, which table has openings in which burners are fixedly flush-mounted to the table by mounting elements which provide a seal. The burners each include a support layer of steel coated on its two faces with an electrically insulating material, and an electrically conducting layer having electrically conductive buses or the like for connecting the burner to an external source of electrical energy.

7 Claims, 1 Drawing Sheet

COOKTOP HAVING A FLAT SURFACE, SUITABLE FOR FLUSH-MOUNTING

The invention relates to a cooking unit which can be flush-mounted, which unit has a heating element; particularly such a unit for domestic use.

Flush-mountable cooking units are known which comprise cooktops of the traditional type having gas burners or having electric burners or plates. Such cooktops have a thickness on the order of 25 mm, which enable flush-mounting in any type of work surface. However, they lack a flat operating surface, in that the gas or electric burners project above the surface. The disadvantage of this type of cooktop is the lack of planarity, particularly in the case where the heating elements are gas burners, which burners require interposition of a support grill for the articles receiving the heat.

Also known are cooktops having halogen or radiant heating elements. Such cooktops customarily consist of:

a vitroceramic glass plate which is adhesively bonded to a housing or other support, and one or more heating elements, particularly halogen or radiant elements, disposed under the vitroceramic glass plate at a specified distance therebelow, viz. on the order to 10–20 min.

When these heating elements are operated, the halogen elements emit IR (infrared) radiation, and the radiant elements emit Joule-effect heat; the heating energy passes through the vitroceramic glass plate, enabling heating of the bottom of the cookware which is intended to receive the heat.

The advantages of the vitroceramic cooktops are numerous. A vitroceramic plate has a very low coefficient of thermal expansion with temperature; further, it transmits the visible and invisible IR radiation emitted by the heating elements disposed below it; and further, it has low thermal conductivity, thereby enabling insulation of the heating zones disposed above the heating elements from the rest of the vitroceramic plate. Also, the cooktop is perfectly planar and has an esthetic appearance.

On the other hand, vitroceramic cooktops are accompanied by a number of disadvantages: A vitroceramic glass plate is susceptible to scratching and is relatively fragile. If an object which is heavy or produces a high impact is dropped onto such a plate, the plate may crack to the extent that it must be replaced. The low thermal conductivity of a vitroceramic plate makes it necessary to provide additional heat to heat the zone in contact with the bottom of the cookware. In addition, vitroceramic cooktops are thicker than traditional cooktops, due to the separation between the cooktop and the heating elements and to the thickness of the plate itself. Vitroceramic cooktops are on the order of 45–50 mm thick, which sometimes makes it difficult to achieve flush-mounting with the surrounding work surface.

The object of the present invention is to devise a flush-mountable cooktop having the advantages of vitroceramic cooktops but in which the disadvantages of such cooktops are eliminated or substantially eliminated, and which is relatively thin, having a thickness on the order to 25 mm.

In particular, the invention relates to a flush-mountable cooktop having at least one heating element; characterized in that it comprises a steel support table covered on its two faces by a layer of an electrically insulated material, which table has openings in which the heating elements are fixedly flush mounted to the table by mounting means which provide a seal, as well as possibly other mounting means.

According to other features of the invention, the burners are each comprised of a support layer steel coated on its two faces with an electrically insulating material and an electrically conducting layer having electric current-supply strips (such as conductive buses or the like) for connecting the burner to an external source of electrical energy. The electrically conducting layer is continuous and pellicular, deposited on the support comprised of coated steel by a vacuum deposition technique, and comprised of chromium. The steel of which the support layer is comprised is an Invar®-type iron-nickel alloy with a low thermal coefficient of expansion. The electrically insulating material is an enamel, for example, a porcelain enamel. The electrically insulating material is a ceramic, said ceramic is deposited under vacuum.

Other characteristics and advantages of the invention will be apparent from the description provided hereinbelow, which description is offered solely by way of example, with reference to the accompanying drawings.

BRIEF DESCRIPTION OF THE SEVERAL FIGURES

FIG. 1 is a perspective view of an exemplary embodiment of a flush-mountable cooktop according to the invention, and FIG. 2 is a partial cross-sectional view along line 2—2 of FIG. 1.

DETAILED DESCRIPTION OF THE SEVERAL FIGURES

The flush-mountable cooktop according to the invention is comprised of a support table 1 and has at least one burner.

Figure 1:
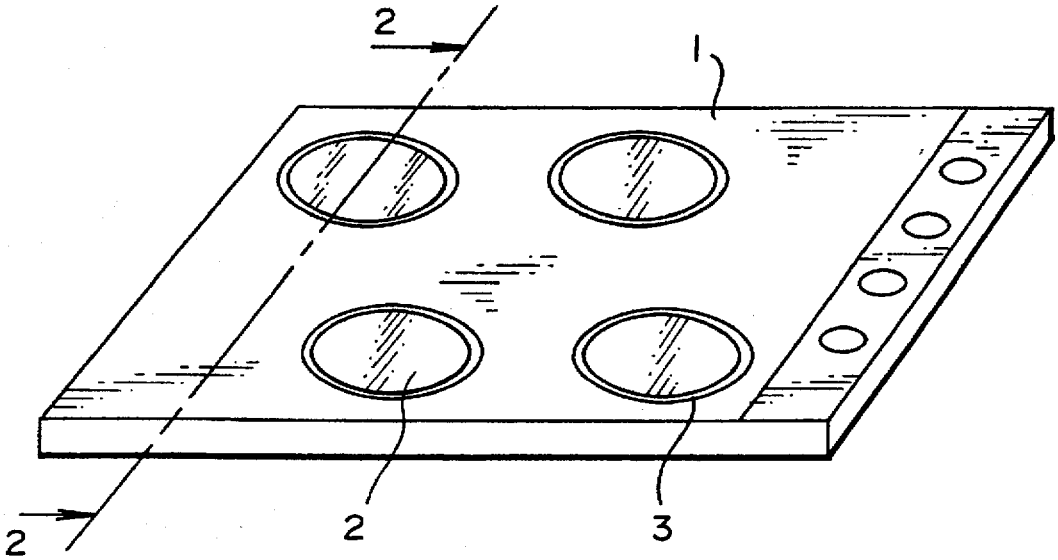
Figure 2:
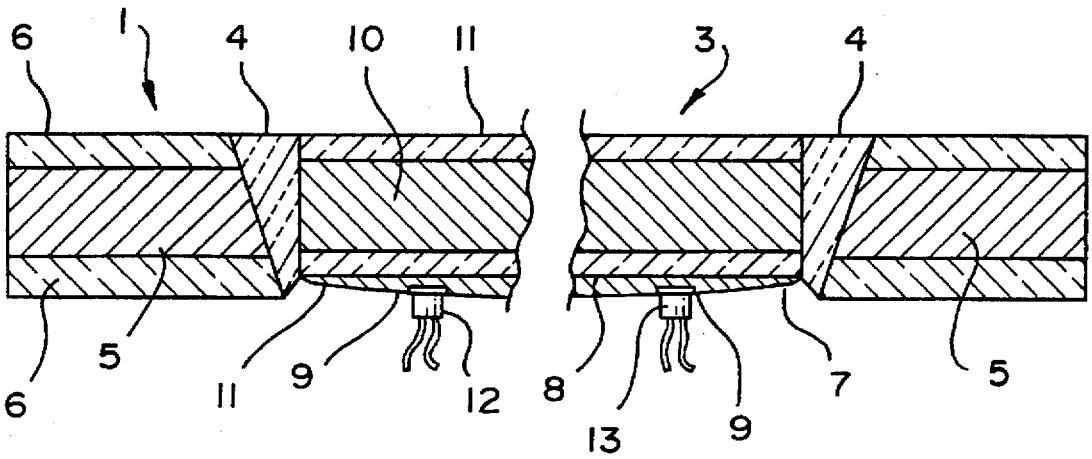

In the embodiment of FIG. 1, the cooktop has four circular burners 2, and on its right side has a set of control button or the like as well as displays, of known type. The burners are generally circular, although other shapes such as oblong or ovoid are possible. The support table 1 has openings 3 in which the burners 2 are fixedly flush-mounted to said openings by mounting means 4 which provide a seal. Advantageously, said mounting means comprise a special adhesive which is resistant to high temperature and has thermal insulation properties, making it possible to substantially prevent propagation of heat from the burners 2 to the support table 1. The sealing adhesive is also engineered such that it absorbs and does not transmit any excess thermal expansion which the burners 2 might undergo, thereby preventing such excess expansion from resulting in deformation of the support table 1. Additional fixing elements of known type (not shown) are employed to fixedly mount the burners 2 to the support table 1; these may be, for example, supporting flanges, lugs, or the like which are fixed to the support table 1 and are attached to the burners (or vice versa) by electrically insulating screw means.

The support table 1 according to the invention is comprised of a steel plate 5 coated on its two faces with a layer 6 of an electrically insulating material. Preferably, the electrically insulating material of the coating layers 6 comprises an enamel for example a porcelain enamel.

The support table 1 illustrated in the drawings is completely planar, but conceivably could have a non-planar shape, for example, having borders with upward or downward projecting configurations. Any forming operation of the support table 1 will be easy to carry out because of the susceptibility of steel to press-forming (i.e., deep drawability).

Each of the burners 2 is comprised of a support layer 7 comprised of an electrically insulating material and an electrically conducting layer 8 which has associated current-supply strips 9 (electrically conducting buses or the like) to connect it to an external source of energy. The electrically conducting layer 8 is continuous and pellicular, and covers nearly all of the support layer 7 of the burner 2. The electrically conducting layer 8 is disposed on the bottom face of the burner 2, which face does not contact the cookware. The support layer 7 is a structure comprised of a steel plate 10 coated on both faces by an electrically insulating material 11 which material is preferably an enamel or a ceramic. In the case of a ceramic, it is deposited on the steel plate 5 under vacuum. The steel in the support layer 7 of the burners 2 is an iron-nickel alloy having a lower coefficient of thermal expansion. As an example, said steel may be a steel known under the trademark Invar®, comprising an iron-nickel alloy with 36% nickel, having a coefficient of expansion of $1\times10^{-6}$ °C. Advantageously, the electrically conducting layer 8 is deposited on the support layer 7 of the burners 2 by metallization under vacuum (e.g., vacuum evaporation vapor deposition or sputtering). Preferably, the electrically conducting layer 8 is comprised essentially of chromium and chromium oxide. The proportion of chromium oxide is chosen to confer appropriate resistivity on layer 8 such that when its terminals are connected to a source of exterior energy, generally 220 V., it will dissipate heat energy at the desired rate. During the vacuum deposition of the layer 8 on the support layer 11 of high electrical resistivity, the residual quantity of oxygen present in the metallization chamber can be controlled so as to obtain a layer of chromium oxide and chromium having a suitable resistivity.

The external energy source may be connected via terminals 12, 13 installed by connecting the ends of appropriate conductors to the lower faces of the current-supply strips 9 by means of soldering or the like. When an electric current is passed through the terminals 12, 13 on the conducting layer 8 of a burner, current passes in the interior of said layer and said layer itself acts as a resistance element to release substantial heat by the Joule effect. This heat is propagated through the relatively thin support layer 7 which is electrically insulative but thermally conductive, and toward the surface of the burner in contact with the cookware. The continuous and pellicular character of the conducting layer 8 enables heating of the cookware to be accomplished much more rapidly than with burners according to the state of the art.

A very advantageous feature of the inventive burner over a vitroceramic burner is the direct contact between the conducting layer 8 and the support layer 7, which enables one to avoid various heat loss phenomena which characterize the state of the art. The materials of construction of the support layer 7 of the burner have good thermal conductivity, much better than that of glass. This enables faster response times in controlling burner heat, etc. and savings of energy.

The inventive cooktop is both flat and very thin. It may have a total thickness of 25 mm or much less, owing to a direct contact rather than a spacing between the conducting layer 9 and the support layer 7 of the burner 2, and owing to the thinness of said support layer 7 and the support table 1, achievable in that said layer 7 and table 1 are fabricated from steel plate. This thinness allows the cooktop to be flush-mounted in any type of work surface, wherewith the overall structure can be kept flat and thin as well.

Another advantage of using a support table 1 and a burner 2 comprised principally of enameled steel is the color flexibility afforded, adding to the range of esthetic effects achievable.

What is claimed:

1. A flush-mountable cooktop, comprising a steel support table having upper and lower faces, each of which is covered by a layer of an electrically insulating material;

at least one burner, each of which includes a support layer of steel having an upper and a lower face, each of which is coated with an electrically insulating material, and a continuous, pellicular electrically conducting layer overlying and in direct contact with the electrically insulating material on the lower face of said support layer, said electrically conducting layer having electric current-supply strips for connecting the burner to an external source of electrical energy;

wherein said support table has openings in which each of said burners is flush-mounted by mounting means which provide a seal between said burners and support table.

2. A flush-mountable cooktop according to claim 1, characterized in that the electrically conducting layer is deposited on the coated steel support by a vacuum metallization technique.

3. A flush-mountable cooktop according to claim 1, wherein the electrically conducting layer is comprised of chromium.

4. A flush-mountable cooktop according to claim 1, wherein the steel of which the support layer is comprised is an iron-nickel alloy having a low coefficient of thermal expansion of a type known by the tradename Invar®.

5. A flush-mountable cooktop according to claim 1, wherein the electrically insulating material is a porcelain enamel.

6. A flush-mountable cooktop according to claim 1, wherein the electrically insulating material is a ceramic.

7. A flush-mountable cooktop according to claim 1, wherein said electrically conducting layer overlies nearly all of the area of said lower face of said support layer.

* * * * *